US005117605A

United States Patent [19]

Waldbeiser

[11] Patent Number: 5,117,605

[45] Date of Patent: Jun. 2, 1992

[54] REPAIR DEVICE FOR AIDING IN RESTORING DAMAGED DRY WALL, SHEET ROCK OR PLASTER BOARD

[76] Inventor: Barry J. Waldbeiser, 18254 N. 87th Dr., Peoria, Ariz. 85345

[21] Appl. No.: 303,736

[22] Filed: Jan. 30, 1989

[51] Int. Cl.[5] ..... E04G 23/02

[52] U.S. Cl. ..... 52/514

[58] Field of Search ..... 52/514

[56] References Cited

U.S. PATENT DOCUMENTS

| | | | |
|---|---|---|---|
| 2,638,774 | 5/1953 | Wieman | 52/514 |
| 3,834,107 | 9/1974 | Standing | 52/514 |
| 3,999,347 | 12/1976 | Devlin | 52/514 |
| 4,075,809 | 2/1978 | Sirkin | 52/514 |
| 4,193,243 | 3/1980 | Tiner | 52/514 |
| 4,297,823 | 11/1981 | Keisler | 52/514 |
| 4,471,594 | 9/1984 | Doyle | 52/514 |

FOREIGN PATENT DOCUMENTS

| | | | |
|---|---|---|---|
| 543 | of 1914 | United Kingdom | 52/514 |

*Primary Examiner*—Richard E. Chilcot, Jr.

[57] ABSTRACT

A kit for repairing a hole and providing a more substantial mounting for a support device, as in a panel of hollow construction such as room partitions, includes a thin sheet of material which is cut to form a plate slightly larger than the size of the hole after it has been cut for mounting. The panel has a center hole and two slots separated and horizontal to such hole and on either side of said center hole, two fairly rigid rounded wires with resilient legs with feet at adjacent ends, has its legs slightly spread apart and the feet inserted through the slots with the feet resting on the rear of the panel. An extruded washer with eight evenly spaced splits is mounted on the rear of the panel by means of three rivets aligning the washer hole evenly with the center hole of the panel. A shaft is then inserted into the center panel hole and through the aligned washer hole and then pushed inwardly. Fingers of opposing hands are inserted into the round wires with the feet properly engaged and then pulling outwardly the plate is firmly set against the inner panel wall of the damaged panel and with the thumb placed on the end of the shaft pressure is applied inwardly until the shaft is seated against a fixed portion of the hollow construction operatively securing and fixing the plate and shaft to the inner and outer walls of the hollow construction. The extruded split washer operatively secures and holds the shaft and any reverse pressure operatively further secures the shaft. The shaft is sized preventing extension into the area being repaired and the damaged area is filled with suitable repair material.

10 Claims, 2 Drawing Sheets

REPAIR DEVICE FOR AIDING IN RESTORING DAMAGED DRY WALL, SHEET ROCK OR PLASTER BOARD

This invention relates to a repair kit, more particularily set forth as a kit for repairing a hole in a panel of hollow construction, and to an installation tool, and a securing washer and shaft forming a part of the kit. Disclosure Document 065227, filed Jan. 30, 1989, has been incorporated into the Patent and Trademark Office file with original application, and is hereby incorporated by reference in this amended application.

BACKGROUND OF THE INVENTION

It is often very difficult if not impossible to repair a sizable hole in sheet rock or wallboard. Small holes caused by nails or the like may be patched with a compound while larger holes require some carpentry and skill in the use of specialized tools. Other expedients are shown in various U.S. Patents, for providing a backing for the patching material. These patented expedients are complicated, inadequate, costly, inefficient and not generally accepted by the public as evidenced that not such expedients are now available to the general public.

For example, in U.S. Pat. No. 3,690,084, shows a number of embodiments securing a hinged perforated plate by means of a pressed assembly seated against the opposed panel of hollow construction. In U.S. Pat. No. 2,997,416, a plate must be cut to the size of the hole to be repaired and then held in place by a bar extending across the inner face of the panel being repaired, with a bolt extending through the bar and threaded into a nut operatively secured to the bar.

BRIEF STATEMENT OF THE INVENTION

The invention in brief, is directed to a kit for the repairing of a hole and reinforcement in a panel of a hollow construction and providing support for the patching material. The kit includes a thin plate slightly larger than the hole to be patched. The hole is squared up slightly smaller than the plate. The plate has a hole in the center to receive a support shaft and two slots longitudinal and on either side of the center hole to receive two metal grasping rings. An extruded split washer is attached to the rear/inner side of the plate directly over and in alignment to the center hole which in turn is secured to the plate by means of three screw or rivets. Two metal round grasping rings operatively effectively rigid each having opposed legs with feet are individually and separately passed through the slots until the feet are seated on the inner/rear side of the opposing ends of the slots. A support shaft is passed through the center hole of the plate extending through the overlapping washer attached to the rear/inner side of the plate. The assembled kit is then passed through the damaged hole by holding the metal grasping rings with one finger of each hand and a thumb on the end of the support shaft, the plate is aligned over the hole and with the grasping rings the plate is pulled outwardly securing the plate to the inner side of the panel. Next the support shaft is pushed inwardly until it seats against the fixed member of the hollow construction, such as a panel. The support shaft is of such a size that when firmly fixed against the far fixed member of the hollow construction until it is flush with the support plate. The grasping rings are then pushed through the slots to fall between the hollow construction so as not to interfere with the patching material Glue is then applied alternatively to the outer side of the plate and a piece of sheet rock or plaster board cut to size is pressed into the hole against the glue and when firmly set compound patching material is spread into any remaining groves or holes completing the repair.

It is the object of this invention to provide a new, simple, useful and inexpensive kit for use in permanently patching a hole in a panel of a hollow construction.

A more specific object is provision of a new, simple and useful kit for patching a hole in a panel of a hollow construction having a fixed part spaced inwardly from and opposed to an inner face of the panel, the kit including, when operatively assembled a plate for insertion through the hole and for abutting engagement with the inner face of the panel, an extruded split washer aligned and attached over the center hole on the rear of the plate, a support shaft when inserted into the center hole of the support plate and extended through the extruded washer effectively spreading the slit ends of the washer and when firmly fixed to the fixed member of the hollow construction operatively engages the plate, washer and shaft in a permanent position. Related object includes the plate and shaft being operatively fixed to each other.

A further object of invention is provision of a new and useful method of preventing subsequent damage to the same area by inward pressure on the panel of hollow construction, that the support shaft when pushed through the split ends of the extruded washer cause said ends to expand operatively creating frictional engagement to the shaft, reverse pressure operatively creating further frictional engagement permanently engaging shaft, washer and plate.

A further object of the invention is provision of a new and useful tool having resilient, opposed legs with feet and the opposite ends being joined by a ring.

These and other objects and advantages of the invention will become apparent from the following description and the accompanying drawing, in which:

DESCRIPTION OF THE ILLUSTRATED EMBODIMENTS

Before proceeding further with a detailed description of the illustrated embodiments of the invention it must be understood that other various materials may be utilized in practicing the invention. Additionally various sizes of the embodiments may be utilized depending upon the size of the damaged area.

Figure 4:
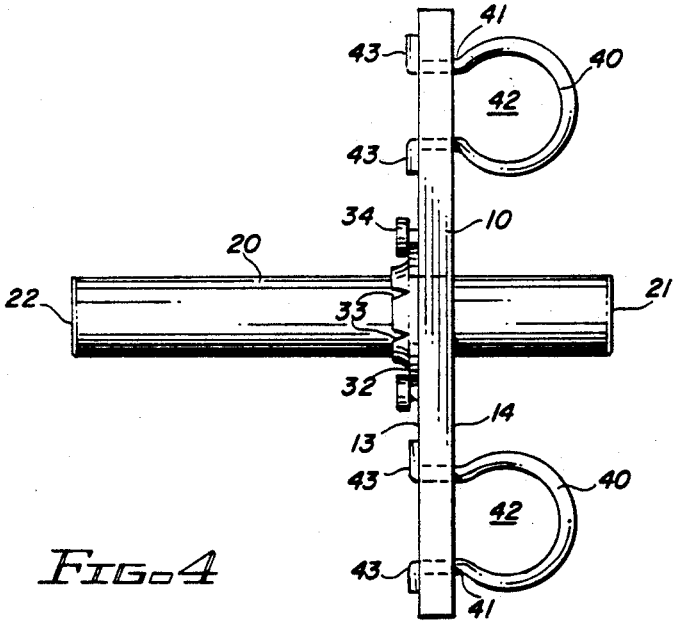
FIG. 4 is the side view of the assembled panel repair kit including the support base plate, support shaft, the two grasping wires and the extruded split washer mounted on the support plate by means of rivets.
Figure 7A:
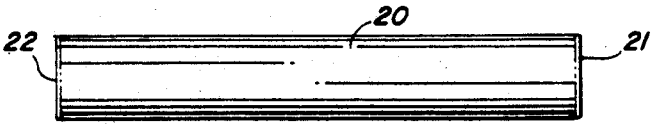
FIG. 7A is the side view of the support shaft.
Figure 7B:
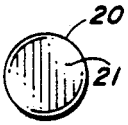
FIG. 7B is the end view of the support shaft.

Referring to the drawings, a repair kit, FIG. 4, is illustrated providing a support backing when repairing a hole 71 in a panel 72 of hollow construction 73 such as dry wall, sheet rock or plaster board, for example.

The repair kit, FIG. 4, includes a support plate 10 with a center hole 11 to receive the support shaft 20 and two slots 12 through which the grasping wires 40 are inserted to aid in positioning the support plate 10 firmly against the inner panel wall 74 of the damaged panel 72. The support plate 10 when firmly positioned provides additional support to the damaged area 71 of the panel 72.

The grasping wire tool 40 for aiding in the installation of the support plate 10 is preferably formed of a single length of slightly resilient steel wire. The grasping wire 40 has a pair of opposing legs 41 which diverge from their outer ends where where they are joined together by a rounded portion 42, to their adjacent ends having feed 43 general parallel to each other and normal to the associated leg 41. In assembling the repair kit, FIG. 4, the rounded portion of the grasping wire 42 is inserted into the slots 21 from the rear of the panel 13 and extended sufficiently so that the feet 43 rest upon the inner side of the panel 13. Each grasping wire 40 is identically inserted. The extruded split washer 30 is mounted on the rear side of the panel 13 by means of three rivets 34, alternatively screws, with the inside diameter of the extruded split washer 31 overlaying the center hole of the support plate 11.

The support shaft 20 is inserted into the center hole 11 of the support plate 10 and extended through the hole 31 of the extruded split washer 30 which is attached to the rear side 13 of the support shaft 10. With fingers inserted into the rounded portion of the grasping wires 42 and the thumb placed on the end 21 of the support shaft 20 the assembly repair kit, FIG. 4, is inserted into the damaged area 71, the plate 10 is then maneuvered into position abutting the inner panel 74 covering the peripheral edge of the damaged area 71, with an outward pressure on the grasping wires 40 the plate 10 is firmly positioned to the inner panel wall 74 while inward pressure is applied to the end 21 of the support shaft 20 until it is fixed and positioned against the member of the hollow construction 75.

Figure 1:
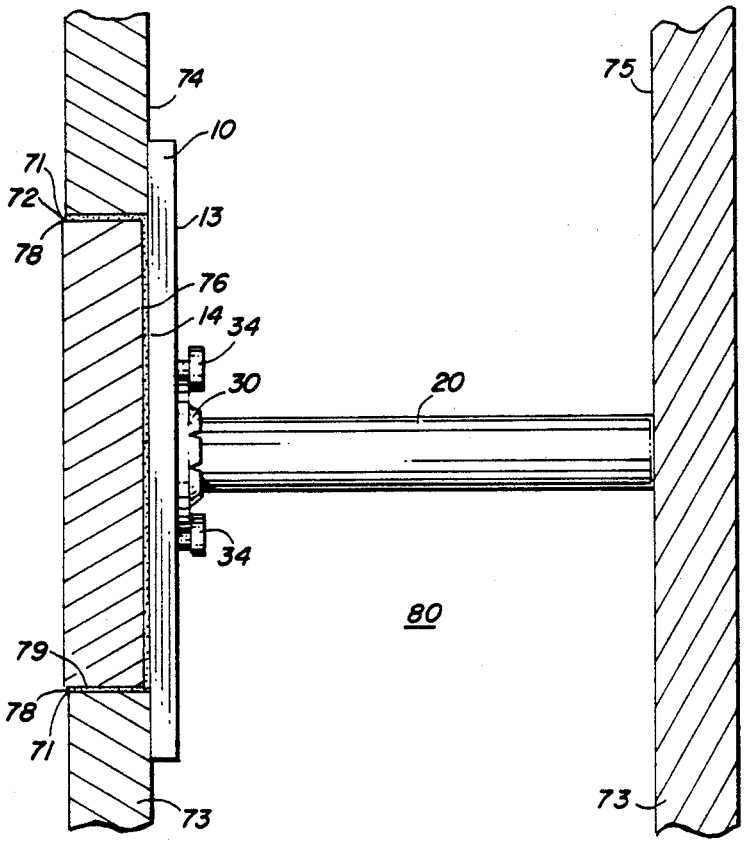
FIG. 1 is the side view of the assembled panel repair kit positioned behind the damaged panel with the support plate and the support shaft firmly seated against the panels of the hollow construction and the damaged area repaired with patching material.
Figure 6A:
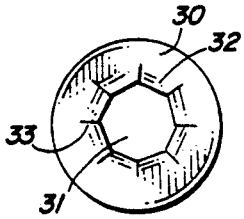
FIG. 6A is the front view of the extruded split washer.
Figure 6B:
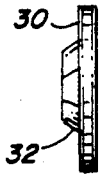
FIG. 6B is the side view of the extruded split washer.
Figure 8A:
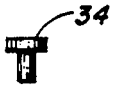
FIG. 8A is the side view of the rivet.
Figure 8B:
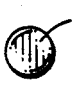
FIG. 8B is the top view of the rivet.
Figure 2A:
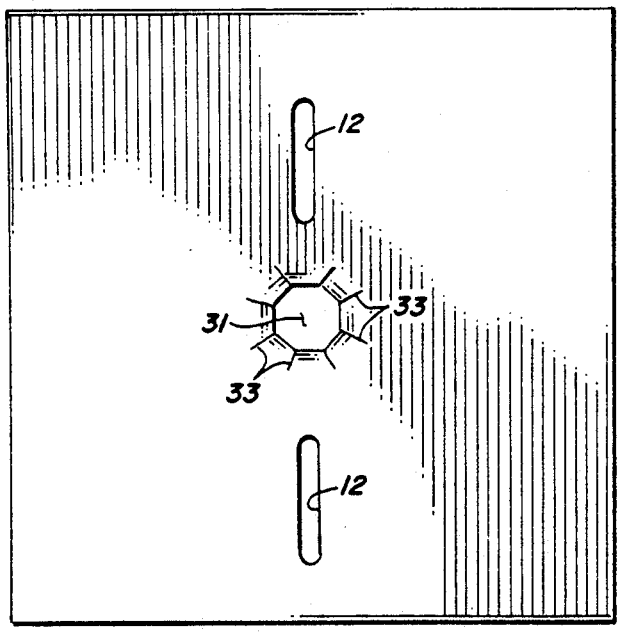
FIG. 2A is the front view of an alternative support plate made of metal with the center hole extruded similar to that of the extruded split washer.
Figure 2B:
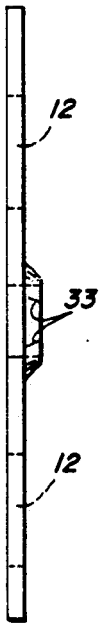
FIG. 2B is the side view of an alternative support plate made with metal with the center hole extruded similar to that of the extruded split washer.
Figure 3A:
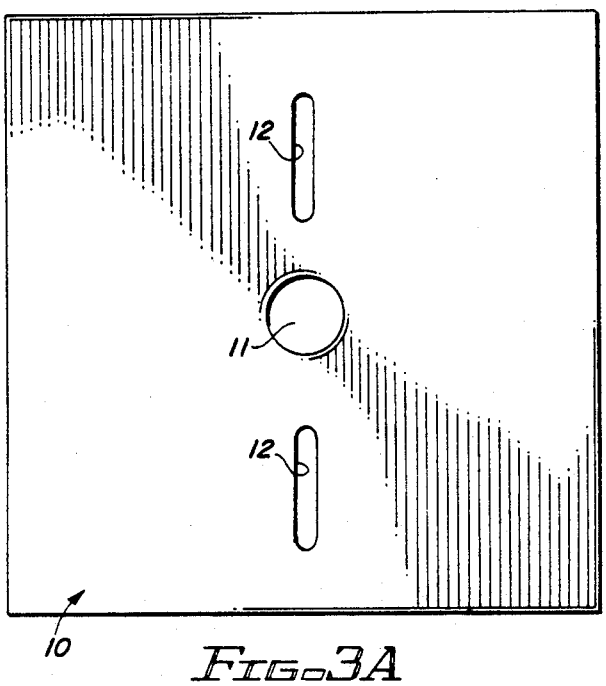
FIG. 3A is the front view of the support base plate indicating the position of the center hole for the support shaft and the two slots that receive the grasping wires.
Figure 3B:
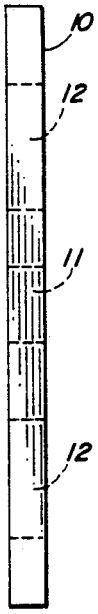
FIG. 3B is the side view of the support base plate as described in FIG. 3A.
Figure 5A:
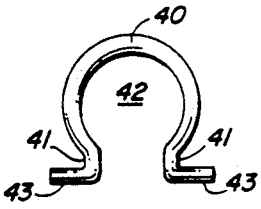
FIG. 5A is the front view of the formed grasping wires.
Figure 5B:
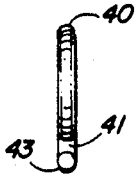
FIG. 5B is the side view of the formed grasping wires.

More particularily the support shaft may be made of polyethelen, plastic or wood of varied measurements from one-sixteenth to one-quarter inch. The support shaft may be of rounded plastic material or wood having a diameter of one-half inch and varied lengths, normally three and one-half inches long. The extruded split washer may be made of metal material one-sixteenth thick with an exterior diameter of one inch and an interior diameter of 0.0480 inches, the extruded portion being approximately one-sixteenth with eight evenly spaced splits extending from the inner opening outward. With the support shaft inserted and inward pressure applied the split end of the extruded washer is separated providing an increased frictional pressure operatively locking the support shaft and the extruded split washer. Reverse pressure on the repair kit serves to increase the locking operation. Alternatively the support plate and the extruded split washer may be substituted and combined as one embodiment as set forth in FIG. 2A.

In repairing the hole and for strengthening the damaged area 72 the hole 71 is usually squared. The extruded split washer 30 is attached to the rear side 13 of the support plate 10 by means of rivets 34. (The support plate 10 and the extruded split washer is anticipated to be pre-assembled). The grasping wires 40 are inserted into the slots 12 of the support plate 10 from the rear side 13 so that the legs 43 are positioned to the rear side 13 of the support plate 10. The support shaft 20 is inserted into the hole 11 of the support plate 10 from the front side 14 and extended a short distance into the hole 31 of the extruded split washer 30. Two fingers are inserted into the rounded part 42 of the grasping wire 40 and manuevers the support plate 10 into the damaged area 71. With the use of the two grasping wires 40 the support base plate 10 is positioned tight against the inner side 74 of the panel 72 with the use of thumb pressure on the end 21 of the support shaft 20 the support shaft 20 is pushed through the hole 31 of the extruded washer 30 until the end of the support shaft 22 is positioned against the fixed wall 75. The grasping wires 40 are then pushed through the slots 12 so that they fall between the existing walls of the hollow construction 80. The extruded split washer serves to firmly position the support plate 10 and the support shaft 20 permanently.

Glue or adhesive is then applied to the face 14 of the support plate 10. A piece of sheet rock or patching material 77 is pressed against the glue 76 and when the glue is set the exposed groves 78 of the damaged area 71 may be filled with spackle or joint compound 79. The repaired area is then sanded and smoothed and ready for painting.

While this invention has been described and illustrated with reference to particular embodiments in a particular environment changes may be apparent to one skilled in the art, and the invention is therefore not to be limited to such embodiments or environment except as set forth in the appended claims.

What is claimed is:

1. A repair kit for the use of repairing a hole in a wall of hollow construction which walls are fixed and spaced inwardly from and opposed to the inner face of the panel to be repaired, the repair kit when operatively assembled comprising such means for insertion of a plate into the hole to be repaired engaging with the inner face of the damaged panel substantially covering the periphery of the hole and having means for positioning in such a manner to which glue and patching material may be applied to fill the damaged area and a hole through which a support shaft is pushed and operatively fixing said shaft to the plate by means of an extruded split washer and that the said end portion of the shaft positioned against the fixed part of the hollow construction, and said positioning means further securing said plate to the inner face of the panel along the periphery of the hole to be patched.

2. A kit set forth in claim 1 in which said cooperating means includes a sufficiently snug longitudinal sliding engagement between shaft and an extruded split washer for operatively engaging said shaft, extruded split washer, support plate and panel to each other.

3. A kit as set forth in claim 1 in which said positioning means including a substantially solid and rigid tool interlocked with said plate for inserting said plate through the damaged hole and into engagement with the inner face of the panel to be repaired.

4. A kit as set forth in claim 1 in which said positioning means including two wire grasping tools interlocked with said plate for inserting said plate through the damaged hole and into engagement with the inner face of the panel to be repaired while the support shaft is being positioned.

5. A kit set forth in claim 1 in which said positioning and engagement means includes a metal extruded split washer for inserting, positioning and engaging with the inner panel to be repaired.

6. A kit as set forth in claim 2 in which said wires includes means releasably interlockable with said shaft for retaining said plate, shaft and wires operatively associated during installation of the assembly.

7. A kit as set forth in claim 4 in which said plate has horizontal slots includes a wire tool with relilient legs extending from said slot to free ends extending through and spaced apart one of said slots, said feet extending from said free ends in the same direction normal to said legs.

8. A kit as set forth in claim 1 in which cooperative means includes an extruded split washer for operatively fixing said plate to said shaft when extended to any distance.

9. A kit as set forth in claim 6 in which extruded split washer means permanent engagement between washer, shaft, plate and panel.

10. A kit as set forth in claim 1 in which when assembled and positioned means additional support to the previously damaged area and any inward pressure causes additional frictional engagement of the assembled kit and the panel.

* * * * *